US005763987A

United States Patent [19]

Morikawa et al.

[11] Patent Number: 5,763,987

[45] Date of Patent: Jun. 9, 1998

[54] FIELD EMISSION TYPE ELECTRON SOURCE AND METHOD OF MAKING SAME

[75] Inventors: Kazutoshi Morikawa; Shinsuke Yura; Shinji Kawabuchi, all of Amagasaki, Japan

[73] Assignee: Mitsubishi Denki Kabushiki Kaisha, Tokyo, Japan

[21] Appl. No.: 636,307

[22] Filed: Apr. 23, 1996

[30] Foreign Application Priority Data

May 30, 1995 [JP] Japan ..... 7-131735

[51] Int. Cl.[6] ..... H01J 1/30; H01J 31/02

[52] U.S. Cl. ..... 313/309; 313/336

[58] Field of Search ..... 313/309, 336, 313/351, 495, 496

[56] References Cited

U.S. PATENT DOCUMENTS

| | | | |
|---|---|---|---|
| 3,753,022 | 8/1973 | Fraser, Jr. | 313/336 X |
| 5,030,895 | 7/1991 | Gray | 313/336 X |
| 5,070,282 | 12/1991 | Epsztein | 313/336 X |
| 5,191,217 | 3/1993 | Kane et al. | 313/336 X |

FOREIGN PATENT DOCUMENTS

| | | | |
|---|---|---|---|
| 0 376 825 | 7/1990 | European Pat. Off. . | |
| 497509 | 8/1992 | European Pat. Off. | 313/336 |
| WO 93 09558 | 5/1993 | WIPO . | |

OTHER PUBLICATIONS

"Fabrication Of Double–Gated Si Field Emitter Arrays" by J. Itoh et al. Revue Le Vide, les Couches Minces Supplement au N 271 –Mar.–Apr. 1994.

"Beam Focusing For Field–Emission Flat–Panel Displays", by W. Dawson Kesling, et al IEEE Transactions on Electron Devies, vol. 42, No., Feb. 2, 1995.

*Primary Examiner*—Hezron E. Williams
*Assistant Examiner*—Daniel S. Lorkin
*Attorney, Agent, or Firm*—Oblon, Spivak, McClelland, Maier & Neustadt, P.C.

[57] ABSTRACT

An electron source includes a cathode electrode having an emitter of conical shape. A first insulating film surrounds the emitter. A first extracting electrode disposed on the first insulating film draws out electrons from the emitter. A second insulating film is disposed on the extracting electrode and a focusing electrode is disposed on the second insulating film for focusing the electrons. The films and electrodes are hollowed to constitute a well surrounding the emitter, and the electrodes are applied predetermined voltages respectively to control the electrons emitted from the emitter. A disturbance that the voltage applied to the focusing electrode causes to the electric field around a summit of the emitter is suppressed. The electrode source may be made by determining a thickness of a masking material so that, when forming the conical emitter, an area occupied by the films deposited on the masking material in the well is smaller than the well when all the films have been completed. The emitter of conical shape is formed in the cathode electrode by using the mask having the determined thickness. The first insulating film, the extracting electrode, the second insulating film, and the focusing electrode are then successively formed, after removing the mask and the layers deposited on the mask successively.

8 Claims, 13 Drawing Sheets

FIELD EMISSION TYPE ELECTRON SOURCE AND METHOD OF MAKING SAME

BACKGROUND OF THE INVENTION

1. Field of the Invention

This invention relates to an electron source, and more particularly, to an electric field emission type electron source for a CRT display, a vacuum tube, a semiconductor manufacturing device, etc., and a method of making the electron source.

2. Description of the Related Art

As background, an electron source which operates with the principle of thermionic emission from a thermal filament has been mainly utilized in the field of image display devices using a cathode ray tube or a vacuum tube.

However, the electron source which operates with the principle of field emission using fine machining techniques in a semiconductor field has recently developed as the image display device is getting thinner and lighter.

FIG. 17 is a sectional view illustrating a part of a background field emission type electron source described in the U.S. Pat. No. 5,070,282, for example. In FIG. 17, an emitter 104 from which an electron is emitted is integratedly formed in a conical shape with a substrate 101 which constitutes a cathode electrode. On the substrate 101, successively disposed are an insulating film 105, an extracting electrode 102, an insulating film 106, a focusing electrode 103, an insulating film 107, and an accelerating electrode 108, the electrodes and films surrounding the emitter 104.

When a voltage from a voltage source 109 is applied between the extracting electrode 102 and the substrate 101, electrons are extracted from the tip of the emitter 104 and are then focused by the voltage of the voltage source 110 applied to the focusing electrode 103. The electrons are further accelerated by the voltage of the voltage source 111 applied to the accelerating electrode 108 before the electrons are finally emitted in the form of an electron beam 100. The embodiment employs a three layer structure composed of the extracting electrode 102, the focusing electrode 103, and accelerating electrode 108, all of the electrodes being subjected to different potentials. For the purpose of emission of electrons, however, only the extracting electrode 102 is needed.

The operation of the electron source will now be described. The application of a positive voltage of 100 V, for example, by the power source 109 to the extracting electrode 102 against the cathode electrode (substrate) 101 generates an electric field of approximately $10^7$ V/cm at the tip of the emitter 104 and causes electrons to be emitted from the emitter 104 by the tunnel effect. The magnitude of the current produced by the emitted electrons ranges from 25 to 100 μA per emitter. Of course, as the density of the emitter 104 increases, the current density increases, but the power consumption is extremely low, because currents hardly flow through the extracting electrode 102.

In the electric field emission type electron source described above, the electron beam 100 emitted tends to diverge based on the influences of the distribution of the electric field which reflects the shape of the tip of the emitter 104. For this reason, a voltage which is approximately identical to that applied to the cathode electrode 101 is applied to the focusing electrode 103 by the power source 110, so as to decelerate the electrons emitted, thereby allowing the electron beam 100 to be focused.

The electron beam 100 is then accelerated by the accelerating electrode 108, to which a positive voltage is applied by a power source 111, before it is projected. It is also possible to accelerate the electron beam 100 by using an external anode in place of the accelerating electrode 108.

Approximately a million emitter arrays can be produced simultaneously with a separation of several micrometers to ten micrometers by employing a photoengraving and thin film technique, enabling realization of an electron source with a peak current of 100 A. The electron source thus obtained has no power loss except for a consumption power due to the current flowing through the cathode electrode 101 and therefore features a low emittance and no diverging electron beams.

The method for fabricating such a conventional electric field emission type electron source is disclosed, for example, on pages 25 to 28 of the collection of papers at the 7th International Vacuum Microelectronics Conference 1994, July. FIG. 18(*a*) through FIG. 18(*f*) are cross-sectional diagrams showing the steps of the fabricating method for the electric field emission type electron source described on pages 25 to 28 of the collection of papers at the 7th International Vacuum Microelectronics Conference July, 1994.

Referring to FIG. 18(*a*), a $SiO_2$ circular film 112 is formed on a substrate 101 made of a semiconductor such as Si or a conductor such as Al, by executing an etching process using a photoresist film 113*a*. After removing the photoresist film 113*a*, the Si substrate 101 is isotopically etched by using the SiO2 circular film 112 as a mask, and then the surface of the substrate 101 is thermally oxidized. This results in forming an oxide film 101*a* all over the surface of the substrate 101 as shown in FIG. 18(*b*). In the next step, a $SiO_2$ insulating film 105 and an electrode 102 made of niobium Nb, for example, are deposited sequentially on the oxide film 101*a* as shown in FIG. 18(*c*). Another photoresist 113*b* is deposited on the electrode 102 to provide a connecting terminal as shown in FIG. 18(*d*), and a $SiO_2$ insulating film 106 and an electrode 103 are deposited sequentially on the photoresist 113*b* and the electrode 102 as shown in FIG. 18(*e*).

Lastly, the photoresist 113*b* is removed and the $SiO_2$ circular film 112 is also removed using hydrofluoric acid. As a result, a part of the oxide film 101*a* is consequently removed from the substrate 101, producing a conical shaped emitter 104 with a sharp summit in an opening 120 as shown in FIG. 18(*f*).

As an example of the dimensions, a diameter of the opening 120, where the emitter 104 is located, is 2 to 3 μm, a height of the conical emitter 104 is 1 μm, and a diameter of the summit of the emitter 104 is 0.06 μm. It is not necessary to increase the thickness of the electrodes 102 and 103 as long as they are thick enough to withstand the voltage applied thereto, and therefore the thickness of the electrodes typically ranges from 0.1 to 0.3 μm.

The thickness of the insulating film 105 is usually set so that it is nearly equivalent to the height of the emitter to ensure efficient emission of electrons from the summit of the emitter 104. And the thickness of the insulating layer 106 is also set to the same thickness, 1 μm, as that of the insulating film 105 to provide adequate dielectric strength between the electrode 102 and the electrode 103.

A CRT electron gun is one of the examples to which the electron source stated above is applied. FIG. 19 shows the configuration of such an electron gun.

In FIG. 19, an electron beam emitted from an electron source (an electron source composed of a field emitter) 121 goes through a first anode electrode 122 and a second anode electrode 123 to be accelerated, and a crossover point 127 by electron lenses 124, 125. The electron beam is then focused through a convergence electrode 126 and the electron trajectories are controlled by a deflecting magnet 128 before the electron beam passes through a shadow mask 129 for being focused onto a fluorescent plate 131 with an aluminum back 130.

The conventional field emission type electron source constituted as described above requires the focusing electrode 103 to have a voltage necessary for obtaining an excellent focusing characteristic applied thereto. In a case that a voltage higher than that of the extracting electrode is applied, a high voltage such as several kilovolts is required, presenting a problem in that it is necessary to increase the thickness of the insulating film between the extracting electrode and the focusing electrode to provide an adequate withstand voltage characteristic, which results in that the power consumption is accordingly increased. For this reason, a voltage lower than that of the extracting electrode is usually applied to the focusing electrode, e.g. a potential of 0 volt is applied to the focusing electrode, and a potential of 100 volts is applied to the extracting electrode.

However, applying a voltage to the focusing electrode which is lower than that applied to the extracting electrode results in a problem in that the electric field at the summit of the emitter is decreased due to the influence of the voltage applied to the focusing electrode and the amount of electrons emitted by the tunnel effect are significantly decreased.

FIG. 20 shows the results of experiments conducted to see the changes in the anode current and the diverging angle of the electron beam with respect to the voltage applied to the focusing electrode. In FIG. 20, the voltage applied to the extracting electrode is standardized at the value of 100 V. It is understood from the chart of FIG. 20 that as the voltage applied to the focusing electrode increases, the anode current increases to obtain sufficient intensity of the electron ray, whereas, electron beams are diverged. On the other hand, if the voltage applied to the focusing electrode is decreased, electron beams would be focused but this causes a significant decrease in current value. This means that the voltage applied to the focusing electrode is so low that the electric field around the summit of the emitter is disturbed.

SUMMARY OF THE INVENTION

Accordingly, the present invention has been made in order to overcome the problems of the background electron source described above.

Accordingly, one object of the present invention is to provide a novel electron source which features a high current density and good focusing performance.

Another object of the present invention is to provide a novel electron source in which an anode current does not decrease even when a voltage lower than that of the extracting electrode is applied to the focusing electrode.

A further object of the present invention is to provide a novel electron source which prevents an influence of a voltage applied to the focusing electrode from affecting an emitter.

A still further object of the present invention is to suppress a disturbance the voltage applied to the focusing electrode causes to the electric field around the summit of the emitter.

In order to achieve such objects, as one feature the electron source of the present invention includes a cathode electrode having an emitter of conical shape, a first insulating film surrounding the emitter, a first extracting electrode disposed on the first insulating film for drawing out electrons from the emitter, a second insulating film disposed on the extracting electrode and a focusing electrode disposed on the second insulating film for focusing the electrons. The films and electrodes are hollowed to constitute a well surrounding the emitter, and the electrodes have applied thereto predetermined voltages respectively to control the electron beam emitted from the emitter. The electron source is also designed so that a disturbance that the voltage applied to the focusing electrode causes to the electric field around the summit of the emitter is suppressed.

Furthermore, the electron source of the present invention may be made by a process of depositing a first insulating film, an extracting electrode for drawing out electrons from an emitter of a cathode electrode, a second insulating film, and a focusing electrode for focusing the electrons on a substrate so that they form a well for disposing the emitter of conical shape. In such a method, a thickness of a masking material is determined so that, when forming the conical emitter, an area occupied by the films deposited on the masking material in the well is smaller than the well when all the films have been completed. The emitter or conical shape is then formed in the cathode electrode by using the mask having the determined thickness. Then, on the substrate the first insulating film, the extracting electrode, the second insulating film and the focusing electrode are successively formed after removing the mask and the layers deposited on the mask successively.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2(*b*) is a cross-sectional view in line A-B of FIG. 2(*a*);

DETAILED DESCRIPTION OF THE PREFERRED EMBODIMENTS

Figure 1:
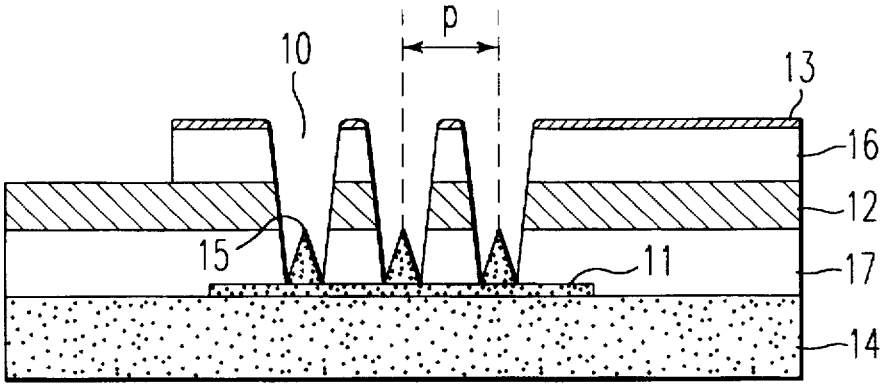
FIG. 1 is a cross-sectional view showing a configuration of a part of an electron source according to a first embodiment of the present invention.

Referring now to the drawings, wherein like reference numerals design identical or corresponding parts throughout the several view, a first embodiment of the present invention will now be described with reference to FIG. 1 and FIG. 2.

FIG. 1 is a cross-sectional view of a part of an electron source according to the present invention. Referring now to FIG. 1, a silicon substrate constituting a cathode electrode 11 is fixed on a substrate 14 which is made of, for example, a glass material. The surface of the cathode electrode 11 is processed to produce a conical shaped field emitter 15. The electron source is constructed by an extracting electrode 12 for drawing out electrons to the emitter 15, a focusing electrode 13 for controlling the trajectories of the emitted electrons, a first insulating film 17 deposited between the electrode 12 and the substrate 14, and a second insulating film 16 deposited between the electrodes 13 and 12, on the substrate 14.

The wells or openings 10 and the field emitters 15 are arranged, for example, at a 7.5 μm pitch in an area of a 200 μm diameter, as shown by the dotted lines in FIG. 1, and at least 600 of them may be incorporated in the area, although FIG. 1 shows only a part of them. The tip of the field emitters 15 are nearly as high as the bottom surface of the extracting electrode 12.

Figure 2A:
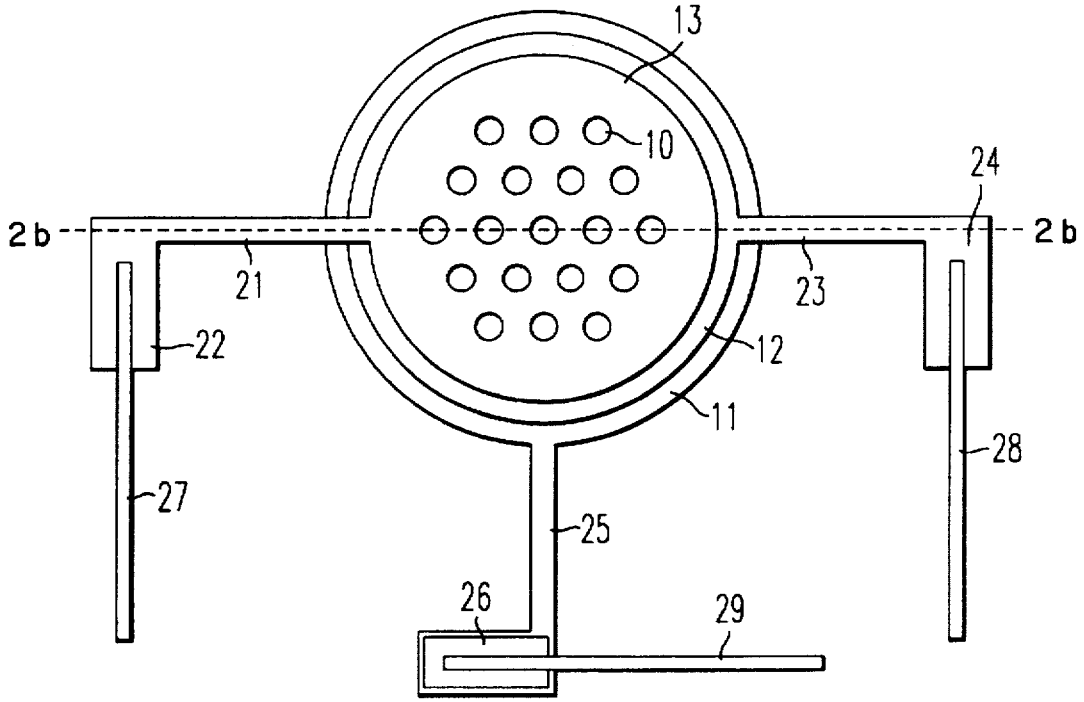
FIG. 2(*a*) is a top view showing an actual configuration of an electron source of the present invention.
Figure 2B:
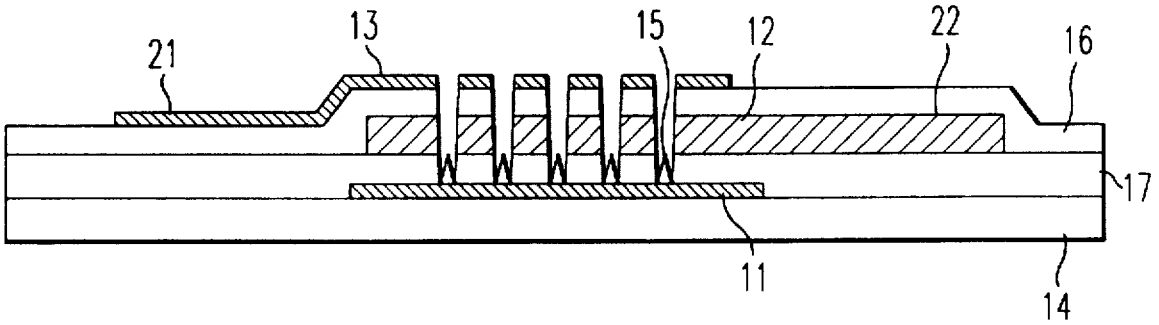

FIG. 2(*a*) is a top view showing an actual configuration of an electron source of the present invention. FIG. 2(*b*) is a cross-sectional view in line A-B of FIG. 2(*a*).

In FIG. 2(*a*), a focusing electrode 13 has a circular area of approximately 300 μm diameter which has a plurality of openings 10 in the central part thereof, i.e. the electron emission area, and has a linear wiring 21 which extends to the left side of FIG. 2 to be connected to a bonding terminal 22 located on the other part of the insulating layer 16. Likewise, the extracting electrode 12 extends to the right side of FIG. 2 through a linear wiring 23 to be connected to a bonding terminal 24 exposed to the space. The cathode electrode 11 also extends outwardly through a linear wiring 25 to be connected to a bonding terminal 26 exposed to the space. Wires 27, 28, 29 are respectively connected to the bonding terminals 22, 24 and 26 to apply voltages thereto.

Figure 3:
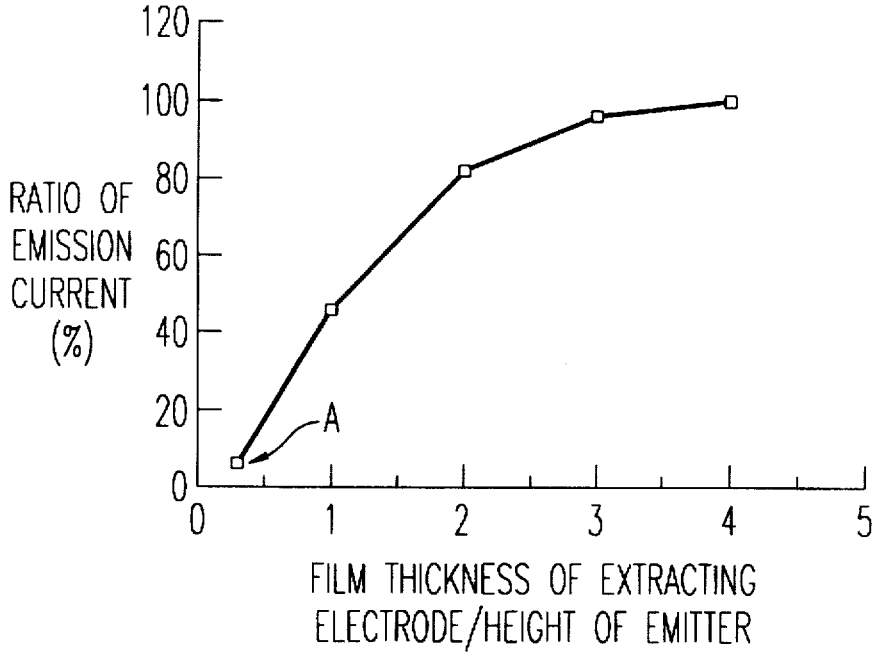
FIG. 3 is a graph showing an electric field analysis result which indicates a relationship between a thickness of the extracting electrode and an emission current.

The operation of the electron source shown in the first embodiment will now be described referring to FIG. 3 to FIG. 5. A voltage of +60 to +110 V is applied to the extracting electrode 12 relative to the voltage applied to the cathode electrode 11, and a voltage of 0 to +20 V is applied to the focusing electrode 13 relative to the voltage applied to the cathode electrode 11. The extracting electrode 12 is thick enough to suppress the disturbance that the voltage applied to the focusing electrode 13 causes to the electric field around the tip of the emitters 15; therefore, the influence of the electric field caused to around the tip of the emitters 15 from the focusing electrode 13 may be reduced. FIG. 3 illustrates a result analyzing the electric field using the calculus of finite differences for the purpose of showing the relationship between the ratio of the thickness of the extracting electrode 12 to the height of the emitters 15 and the currents emitted from the summits of the emitters 15. The axis of abscissa indicates the ratio of the thickness of the extracting electrode 12 to the height of the emitters 15, and the axis of ordinate indicates the values of current which is emitted from the tips of the emitters 15, showing herein as 100% the value of current at the time when the focusing electrode 13 is not employed.

Point A in FIG. 3 indicates the percentage of the emission current when the focusing electrode 13 is used under a conventional film thickness condition, that is, the height of the emitters 15 is 1 μm and the thickness of the extracting electrode 12 is 0.3 μm, representing that the current emitted from the summits of the emitters 15 is increased in accordance with the increase of the thickness of the extracting electrode 12. In FIG. 3, the Applicants of the present invention have found that 80% or more of the emission current can be secured when the ratio of the thickness of the extracting electrode 12 to the height of the emitters 15 is 2 or more, and 100% of the emission current can be secured when the ratio of the thickness of the extracting electrode 12 to the height of the emitters 15 is 4.

Thus, an electron beam which has a high current density and an excellent focusing property can be obtained by increasing the thickness of the extracting electrode 12.

On the other hand, as the extracting electrode 12 is made thicker, a pitch p between adjacent emitters 15 in FIG. 1 increases by the reasons described later, and the number of emitters 15 per unit area therefore decreases. For this reason, when a plurality of emitters 15 are formed to provide an electron source, the total value of currents emitted from all emitters 15 decreases because it depends on the value of current emitted from one emitter and the number of the emitters. FIG. 4 shows the relationship between the ratio of the thickness of the extracting electrode 12 to the height of the emitters 15 and the total emission currents when the total value of the currents emitted from a group of emitters, which provide focusing performance and do not incur a drop in emission currents, is taken as 100%.

Figure 4:
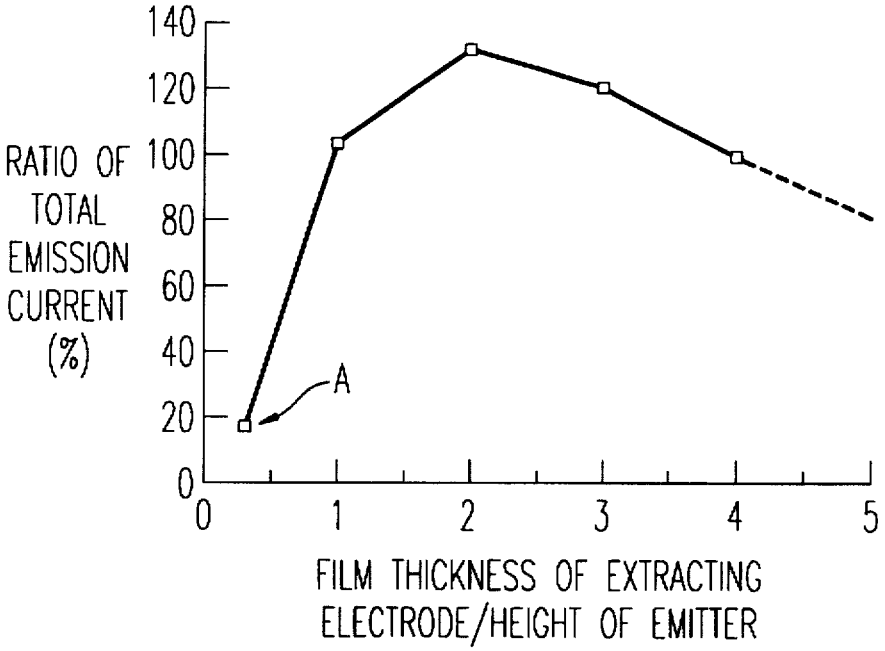
FIG. 4 is a graph showing an electric field analysis result which indicates a relationship between a thickness of the extracting electrode and a total emission current.

As shown in FIG. 4, the Applicants of the present invention have found that a total emission current of approximately equal to or higher than that of the background electron source can be obtained when the ratio of the thickness of the extracting electrode 12 to the height of the emitters 15 is between 1 to 4.

Another method for increasing the total emission current is to optimize the material used for the electrodes and the voltage to be applied. For example, a literature, namely the collection of papers at the 7th International Vacuum Microelectronics Conference (July 1994) page 405 to page 407, reports on an increase in the total emission current achieved by providing emitters with the anode forming treatment.

More specifically, the drop in the total emission current by the increase of the thickness of the extracting electrode 12 can be compensated for by optimizing other parameters such as the material used for the electrodes and the voltage to be applied. As shown in FIG. 4, if the ratio of the total emission current is at least 40%, it is possible for the total emission current to be compensated up to 100% (2.5 times). This means that a total emission current of approximately equal to or more than the background level can be obtained when the ratio of the thickness of the extracting electrode 12 to the height of the emitters 15 is more than 0.5.

Figure 5:
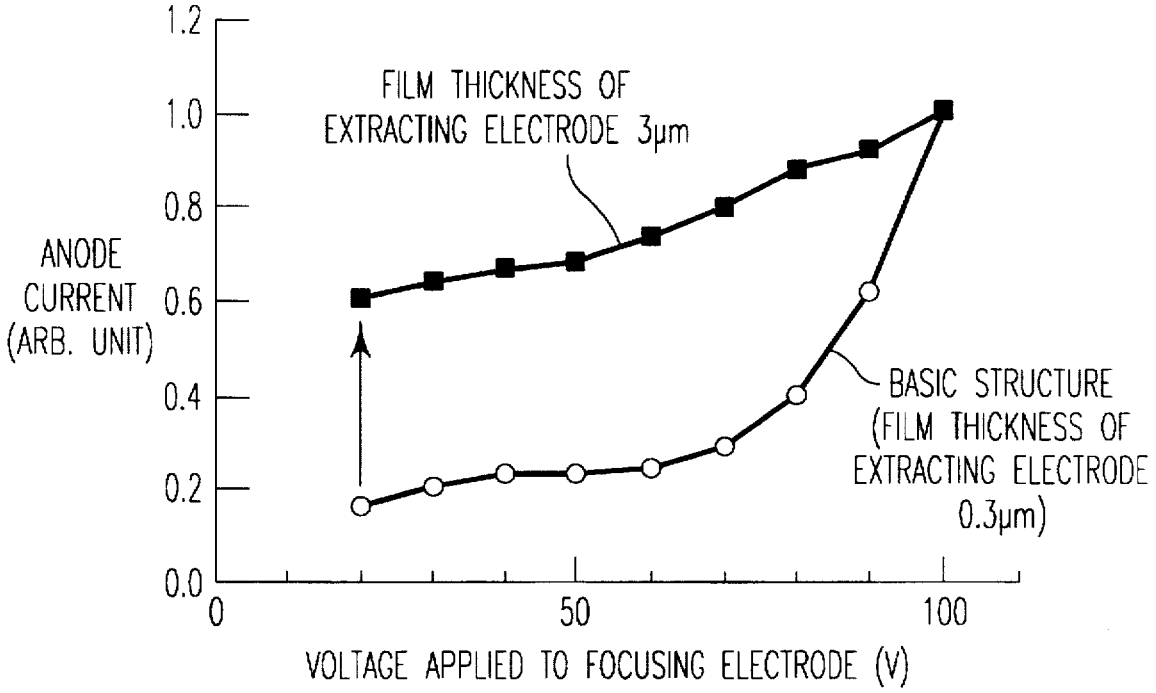
FIG. 5 is a graph showing a relationship between a voltage applied to the focusing electrode and an anode current observed when a thickness of the extracting electrode is changed.

FIG. 5 shows the comparison in the change in the anode current when the film thickness of the extracting electrode 12 is increased from the background thickness, namely, 0.3 μm to 3 μm for example, that is ten times (herein the height of the emitter is 1 μm). As apparent from FIG. 5, by making the thickness of the extracting electrode 12 thicker, the preferred embodiment of the present invention may control the sharp drop in the anode current even when the voltage applied to the focusing electrode 13 is decreased, enabling to secure a sufficient current density for the electron source.

In other words, the present invention can provide an electron source which has a high current density by focusing the electron beam even when a low voltage is applied to the focusing electrode 13.

The electrons emitted from the summits of the field emitters 15 are decelerated and focused by the electric field generated by the focusing electrode 13 before they are emitted toward the anode which is provided outside the electron source.

Figure 6:
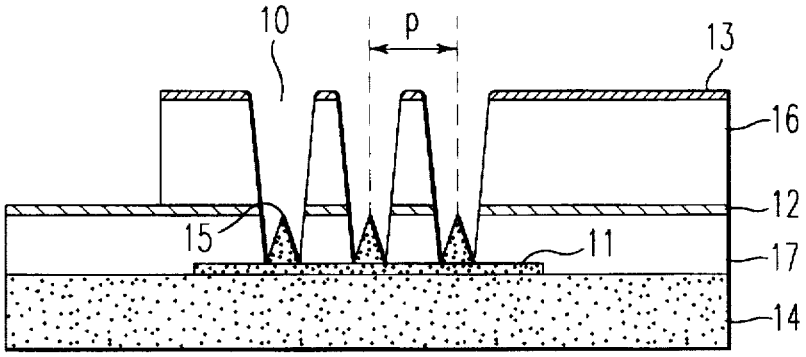
FIG. 6 is a cross-sectional view showing a configuration of a part of an electron source according to a second embodiment of the present invention.

Another embodiment of the present invention will be described with reference to FIG. 6 to FIG. 8. FIG. 6 is a cross-sectional view illustrating a part of an electron source according to the second embodiment. The electron source in FIG. 6 differs from the background one in that the second insulating film 16, which is located between the extracting electrode 12 and the focusing electrode 13, is made sufficiently thick. The operation of the electron source thus configured will now be described.

A voltage applied to the extracting electrode 12 is +60 to +110 V relative to a voltage applied to the cathode electrode 11, and a voltage applied to the focusing electrode 13 is 0 to +20 V relative to the voltage applied to the cathode electrode 11.

Figure 7:
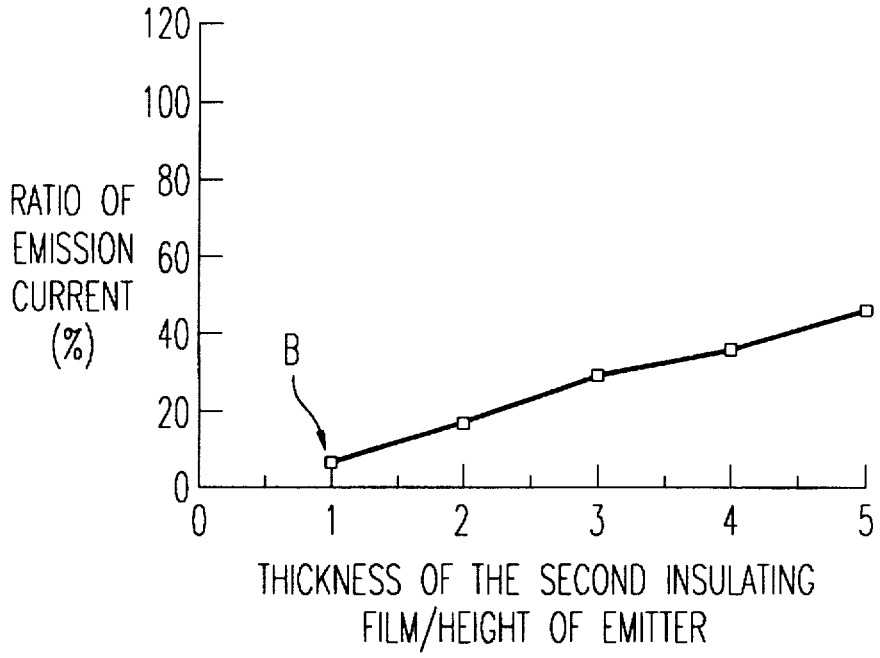
FIG. 7 is a graph illustrating an electric field analysis result which indicates a relationship between a thickness of a second insulating layer and an emitted current.

FIG. 7 illustrates a result analyzing the electric field using the calculus of finite differences, for the purpose of showing the relationship between the ratio of the thickness of the second insulating film 16 to the height of the emitters 15 and the currents emitted from the summits of the emitters 15. The axis of abscissa indicates the ratio of the thickness of the second insulating film 16 to the height of the emitters 15, the axis of ordinate indicates the values of current which is emitted from the tips of the emitters 15, showing herein as 100% the value of current at the time when the focusing electrode 13 is not employed. Point B in FIG. 7 indicates the percentage of the emitted current when the focusing electrode 13 is used under a background film thickness condition, that is, the height of the emitters 15 is 1 μm and the thickness of the second insulating film 16 is 1 μm.

As apparent from FIG. 7, the Applicants of the present invention have found that the current emitted from the summits of the emitters 15 is increased in accordance with the increase of the thickness of the second insulating film 16. In particular, 30% or more of the emission current can be secured when the ratio of the thickness of the second insulating film 16 to the height of the emitters 15 is 3 or more, compared with less than 10% in the background device.

Therefore, the second embodiment which increases the thickness of the second insulating film 16 instead of the extracting electrode 12 in the first embodiment, can also provide an electron source which has a high current density by focusing the electron beam even when a low voltage is applied to the focusing electrode 13.

Figure 8:
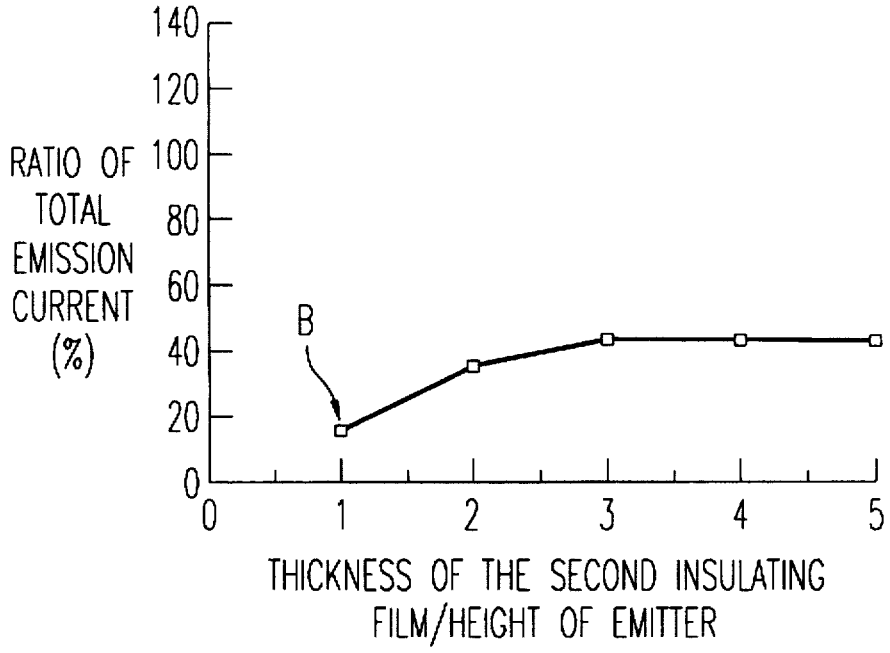
FIG. 8 is a graph illustrating an electric field analysis result which indicates a relationship between a thickness of a second insulating layer and a total emitted current.

FIG. 8 shows the relationship between the ratio of the thickness of the second insulating film 16 to the height of the emitters 15 and the total emission currents when the total amount of the emission currents emitted from a group of emitters, which provide focusing performance and do not incur a drop in emission currents, is taken as 100%. As shown in FIG. 8, the total current of the group of emitters reaches a saturation point at about 40% when the ratio of the thickness of the second insulating film 16 to the height of the emitters 15 is 2.5 or more. As described in the first embodiment, when the total current of the group of emitters is about 40%, the total current can be compensated for up to 100% by optimizing other parameters. Accordingly, when the height of the emitters 15 is 1 μm, the thickness of the second insulating film 16 may be 2.5 μm. The upper limit of the thickness should be approximately 10 μm, i.e. ten times, considering the thick film technique.

Figure 9:
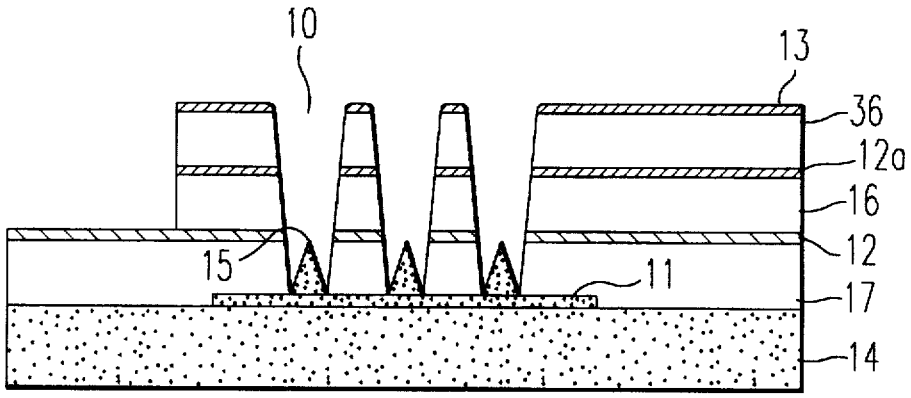
FIG. 9 is a cross-sectional view showing a configuration of a part of an electron source according to a third embodiment of the present invention.

Still another embodiment of the present invention will be described with reference to FIG. 9 and FIG. 10. FIG. 9 is a cross-sectional view illustrating part of an electron source according to the third embodiment. In this embodiment, a second extracting electrode **12*a* is provided between the first extracting electrode 12 and the focusing electrode 13 via the first insulating film 17, the second insulating film 16, and a third insulating film 36**.

The operation of the electron source thus configured will now be described. A voltage applied to the first extracting electrode 12 is +60 to +110 V relative to a voltage applied to the cathode electrode 11, and a voltage applied to the focusing electrode 13 is 0 to +20 V relative to a voltage applied to the cathode electrode 11. Applied to the second extracting electrode **12*a* is a potential, +50 V, for example, which is higher than that of the focusing electrode 13 and lower than that of the first extracting electrode 12. The second extracting electrode 12*a* serves to block the influences of the intensity of the electric field at the focusing electrode 13, so that a sufficient electric field may be obtained in the vicinity of the summits of the emitters 15. Accordingly, as in the first and second embodiments, it is possible in this embodiment to provide an electron source which is capable of generating electron beams with a high current density even if the voltage applied to the focusing electrode 13** is decreased to focus electron beams. Further, the multilayer design of this embodiment eliminates the necessity for making the individual layers unusually thicker than in the first and second embodiments, reducing the possibility of occurrence of internal stress in the individual layers.

In the third embodiment described above, the voltage potential applied to the second extracting electrode 12a is set to a level somewhere between the potential applied to the first extracting electrode 12 and the potential applied to the focusing electrode 13; however, the potential may be set to the same level of the first extracting electrode 12 by electrically conducting the first extracting electrode 12 and the second extracting electrode 12a through an external circuit. This results in reducing the number of power supplies, making it possible to achieve a high-performance electron source with a simpler structure.

Figure 10:
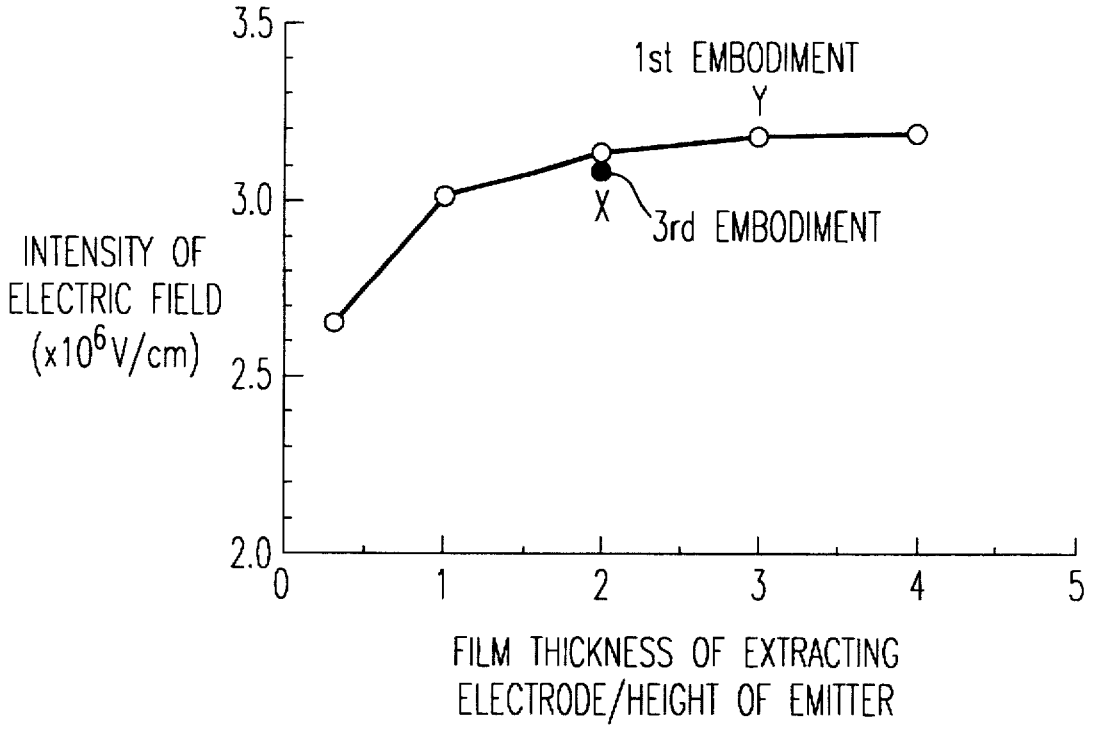
FIG. 10 is a graph illustrating an effect of the three-stage electrode structure which has a second extracting electrode.
Figure 12A:
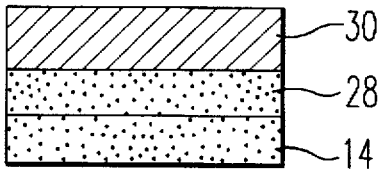
FIGS. 12(*a*)–12(*e*) are cross-sectional views illustrating a method of making an electron source.
Figure 12B:
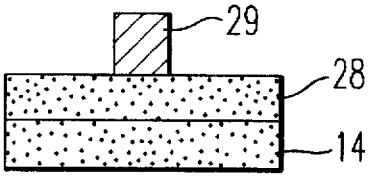
Figure 12C:
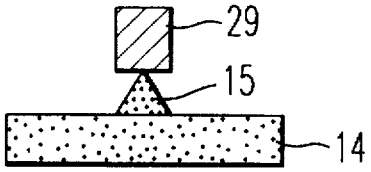
Figure 12D:
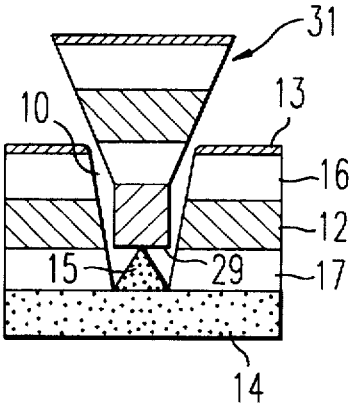
Figure 12E:
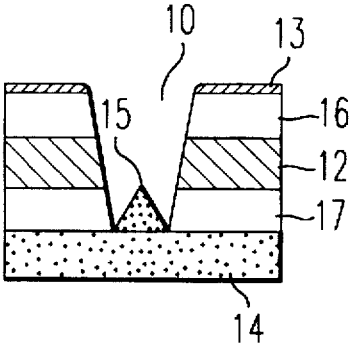

FIG. 10 shows the relationship between the ratio of the film thickness of the extracting electrode to the height of the emitters 15 and the intensity of electric field at the summits of the emitters 15, for the purpose of comparison in effects between the third embodiment and the first embodiment. In FIG. 10, X designates the intensity of electric field in the third embodiment when the ratio of the film thickness of the extracting electrode to the height of the emitters 15 is 2. It has been confirmed that nearly a same effect as that in the first embodiment designated as Y is obtained. The thickness of the extracting electrode in the third embodiment is a sum of the thickness of the first and second extracting electrodes 12, 12a and the thickness of the second insulating film 16, and therefore, the respective layers can be made thinner than those in the first embodiment. Further, by adjusting the potential applied to the first and second extracting electrodes 12, 12a, it is possible to eliminate the necessity for making the first and second extracting electrodes 12, 12a thicker.

Figure 11:
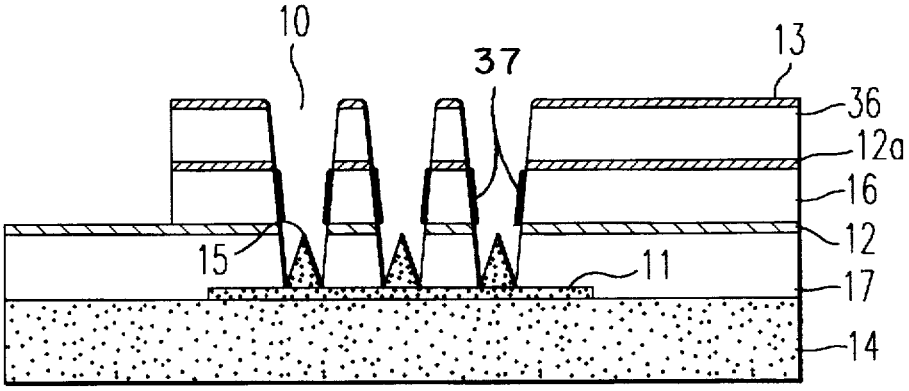
FIG. 11 is a cross-sectional view showing a configuration of a part of an electron source according to a fourth embodiment of the present invention.

A further embodiment of the present invention will be described with reference to FIG. 11 which is a cross-sectional view showing a part of an electron source according to a fourth embodiment of the present invention. In FIG. 11, the second extracting electrode 12a is provided between the first extracting electrode 12 and the focusing electrode 13 via the insulating films 16 and 36, and an electrode shunt 37 is provided to connect the first extracting electrode 12 and the second extracting electrode 12a through the inner wall of the well 10.

This fourth embodiment eliminates the necessity for connecting the first extracting electrode 12 to the second extracting electrode 12a outside as in the third embodiment. Further, the multilayer design of this embodiment of FIG. 11 eliminates the necessity for making the individual layers unusually thicker than as in the first and second embodiments, reducing the possibility of occurrence of internal stress in the individual layers.

A method of making the electron source of FIG. 1 will now be described below by referring to FIGS. 12(*a*)–12(*e*).

As shown in FIG. 12(*a*), on a substrate 14 made of glass material, an emitter material 28 composed by Si, for example, and a circular masking material 30 are deposited successively by any well-known method. Thereafter, the circular masking material 30 is processed to make the circular mask 29 so as to form an emitter 15 as illustrated in FIG. 12(*b*). The mask 29 is composed with $Si_3N_4$ or $SiO_2$ and acts as a photoresist mask for etching. It is followed by chemical etching to form the emitter 15 as illustrated in FIG. 12(*c*).

In FIG. 12(*d*), next, on the substrate 14, the first insulating film 17 composed by SiO, the extracting electrode 12 composed of a metal such as Nb, Au, and Pt, the second insulating film 16 composed by $SiO_2$, and the focusing electrode 13 are deposited sequentially by the evaporation method on an area where the circular mask 29 and the emitter 15 are not formed. In this step, the circular mask 29 prevents the insulating material or electrode material from adhering to the emitter 15. In FIG. 12(*e*), the circular mask 29 and an unnecessary deposit 31 comprising the insulating films 17, 16 and electrodes 12,13 are removed by etching using a solution of hydrofluoric acid.

Figure 13A:
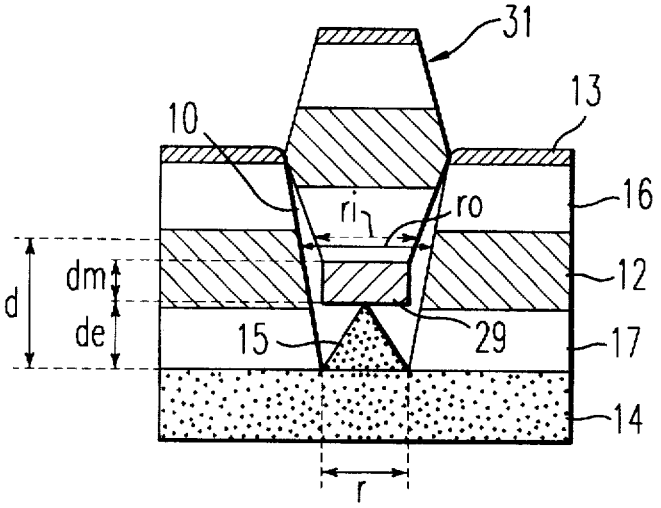
FIG. 13(*a*) and FIG. 13(*b*) are schematic diagrams illustrating a difference in a configuration of an electron source fabricated depending on a thickness of a mask.
Figure 13B:
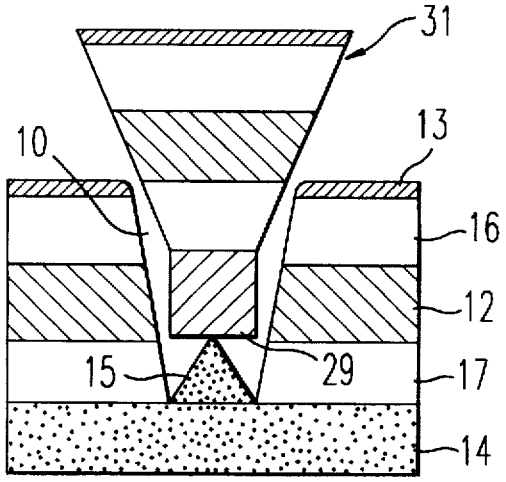

FIG. 13 shows how different thicknesses of the circular mask 29 results in different electron sources. FIG. 13(*a*) illustrates a structure obtained when the thickness of the circular mask 29 is not optimized, whereas FIG. 13(*b*) illustrates a structure obtained when the thickness of the circular mask 29 is well optimized. In FIGS. 13(*a*) and 13(*b*), "de" denotes the height of the emitter 15, "dm" denotes the thickness of the circular mask 29, "d" denotes the thickness of a film (of any type) being produced in FIG. 12(*d*), measured from the surface of the substrate 14, "ro" denotes the diameter of the well 10 at the height of d, "ri" denotes the diameter of the deposit on the circular mask 29 at the height of d, and "r" denotes the diameter of the well 10 measured on the substrate 14. During the film depositing process, the films on the substrate 14 are grown so that their well becomes wider as it goes upward, and the diameter of the films on the circular mask 29 becomes larger, starting with the diameter of the circular mask 29.

At this time, the circular mask 29 must be made sufficiently thick, because the expansion of the films on the circular mask 29 is greater than the expansion of the films on the substrate 14, otherwise, the well 10 will be closed as shown in FIG. 13(*a*) before the deposition of the films is completed. This makes it difficult to remove the unnecessary deposit, preventing the fabrication of the electron source. To avoid this, the circular mask 29 should be made sufficiently thick as shown in FIG. 13(*b*).

Figure 14:
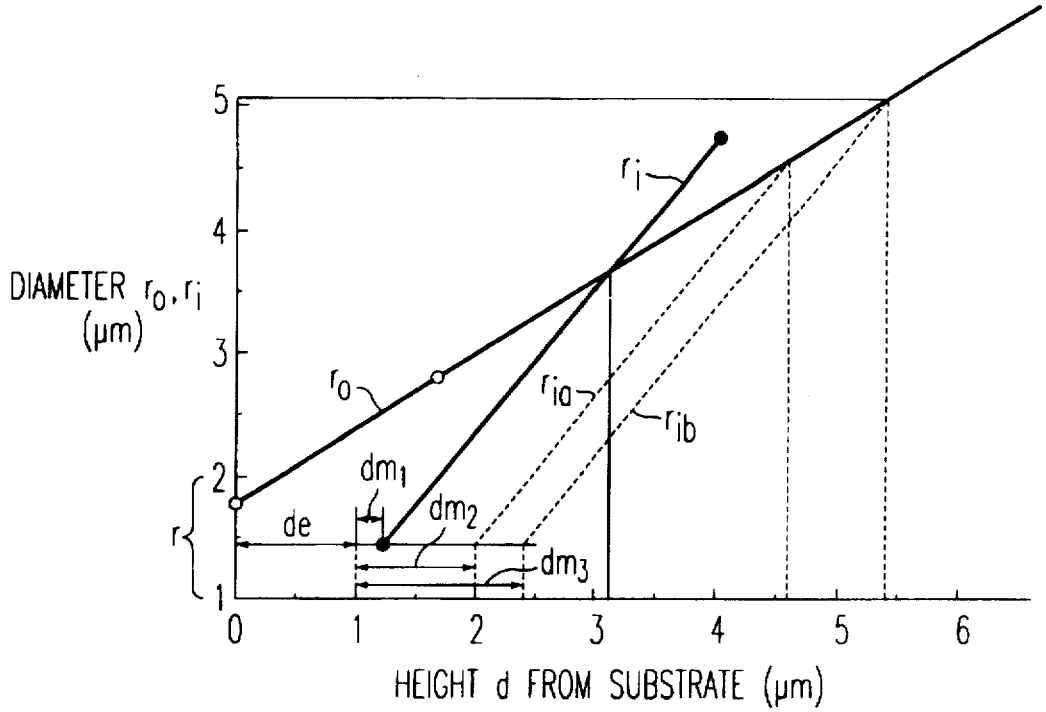
FIG. 14 is a graph illustrating a relationship between a height from a substrate and a diameter of a deposit on a mask and an inside diameter of a well or opening, which is used for deciding the thickness of a mask.
Figure 20:
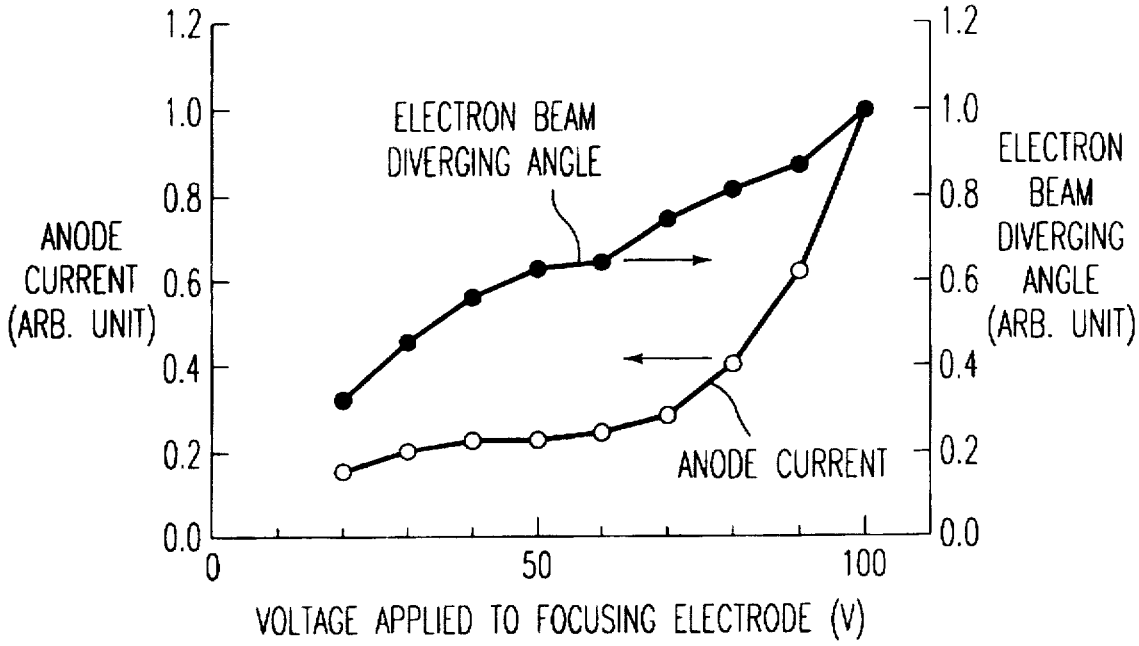
FIG. 20 BACKGROUND ART
FIG. 20 is graph showing a relationship between the voltage applied to a focusing electrode and an anode current and a diverging angle of an electron beam in the background electron source.

A specific technique for setting the thickness of the circular mask 29 will now be described with reference to FIG. 14. FIG. 14 is a graph showing the relationship between the diameter "ro" of the well 10 and the diameter "ri" of the deposit on the circular mask 29 at the height "d" measured from the surface of the substrate 14. In the background type device, the height "de" of the emitter is 1 μm, the thickness "dm1" of the mask is usually 0.3 μm, and the diameter "r" of the well 10 is 1.8 μm. The height "d" from the substrate at the intersection of "ro" and "ri" is approximately 3.2 μm at the well diameter of 1.8 μm. Further, the first insulating film 17 is about 1 μm thick, the extracting electrode 12 is 0.3 μm thick, the second insulating film 16 is about 1 μm thick, and the focusing electrode 13 is 0.3 μm thick; therefore, total film thickness is 2.6 μm, enabling an electron source to be completed without closing the well. On the other hand, in the case that the insulating film is designed as in the second embodiment, for example, if the thickness of the second insulating film 16 is set to 3 μm thick, then total film thickness is 4.6 μm, preventing an electron source from being completed unless the circular mask 29 is made thicker.

Hence, based on FIG. 14, "ri" is moved to "ria" in parallel along the arrow so that the intersection of "ro" and "ri" would be 4.6 and more in the height "d" resulting in that the circular mask 29 thickness to be designed is "dm2". It can be seen in this embodiment that setting the thickness of the circular mask 29 to 1 μm or more makes it possible to produce the electron source without causing the well 10 to be closed.

Further, in a case that the extracting electrode 12 in the first embodiment is set to 3 μm, the total film thickness will be 5.3 μm. Therefore, based on FIG. 14, "ri" is moved to "rib" in parallel along the arrow so that the intersection of "ro" and "ri" would be 5.3 and more in the height "d" resulting in that the circular mask 29 thickness to be designed is "dm3". It can be seen in this embodiment that setting the thickness of the circular mask 29 to 1.4 μm or more makes it possible to produce the electron source without causing the well 10 to be closed.

The slopes in the graph slightly vary according to the type of the vapor deposition equipment or the like used, however, even if different equipment is used, the same procedure can be applied to design the optimum thickness of the circular mask 29 by determining the relationship between "ro" and "ri" beforehand.

Figure 15:
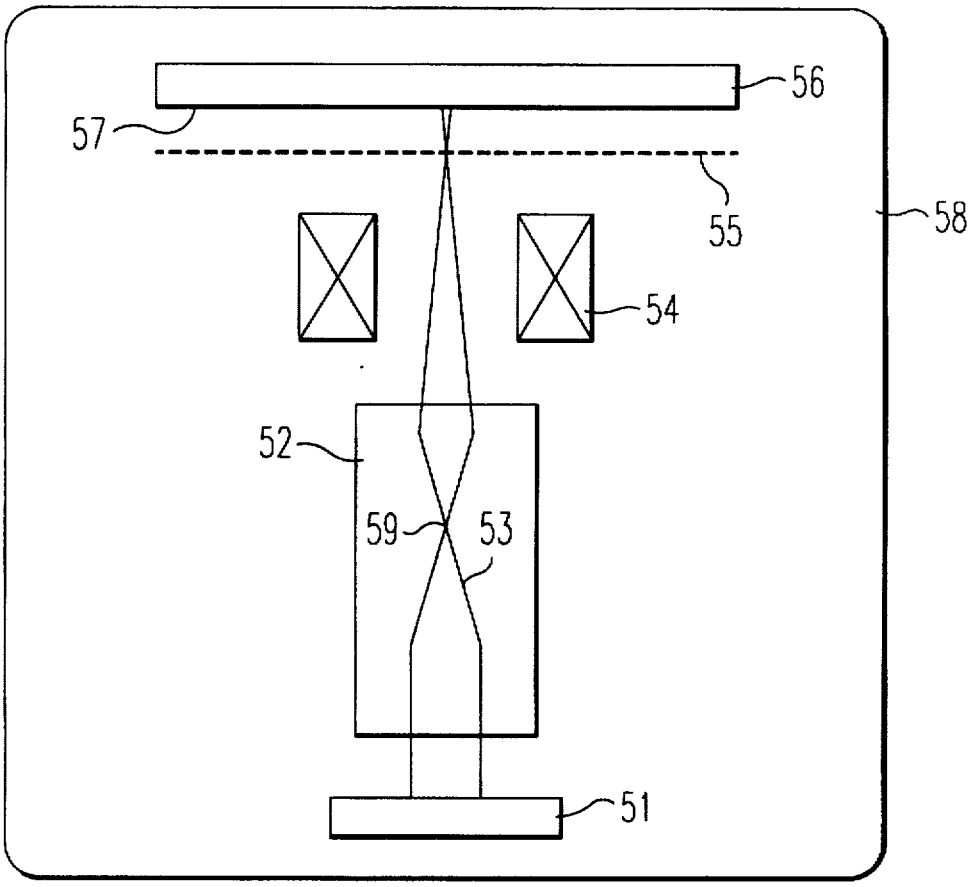
FIG. 15 is a cross-sectional view showing a configuration of a cathode ray tube incorporating the electron source of any one of the first to fourth embodiments of the present invention.

FIG. 15 is a cross-sectional view illustrating a structure of a cathode ray tube which employs the electron source described in the first to fourth embodiments of the present invention. In FIG. 15, an electron beam 53, which is emitted from an electron source 51 constructed by a single emitter or a plurality of emitters, forms a crossover point 59 in an electron gun 52, which is the means for focusing electron beams, then the electron beam 53 is deflected by a deflecting magnet 54 and is led via a shadow mask 55 to a desired position on a phosphor plate 56 having an aluminum film 57. The components constituting the cathode ray tube are enclosed in a vacuum container 58. The cathode ray tube incorporating the electron source 51 described above makes it possible to obtain a sufficient focusing characteristic, since the electron beam 53 emitted from the electron source 51 is already focused. This leads to improved resolution of the cathode ray tube, resulting in a high quality picture image.

In each of the specific embodiments of the present invention described, the emitter 15 made of Si was formed on the substrate 14 made of glass, but it is possible to integrate the emitter and the substrate into a single Si piece.

Figure 16:
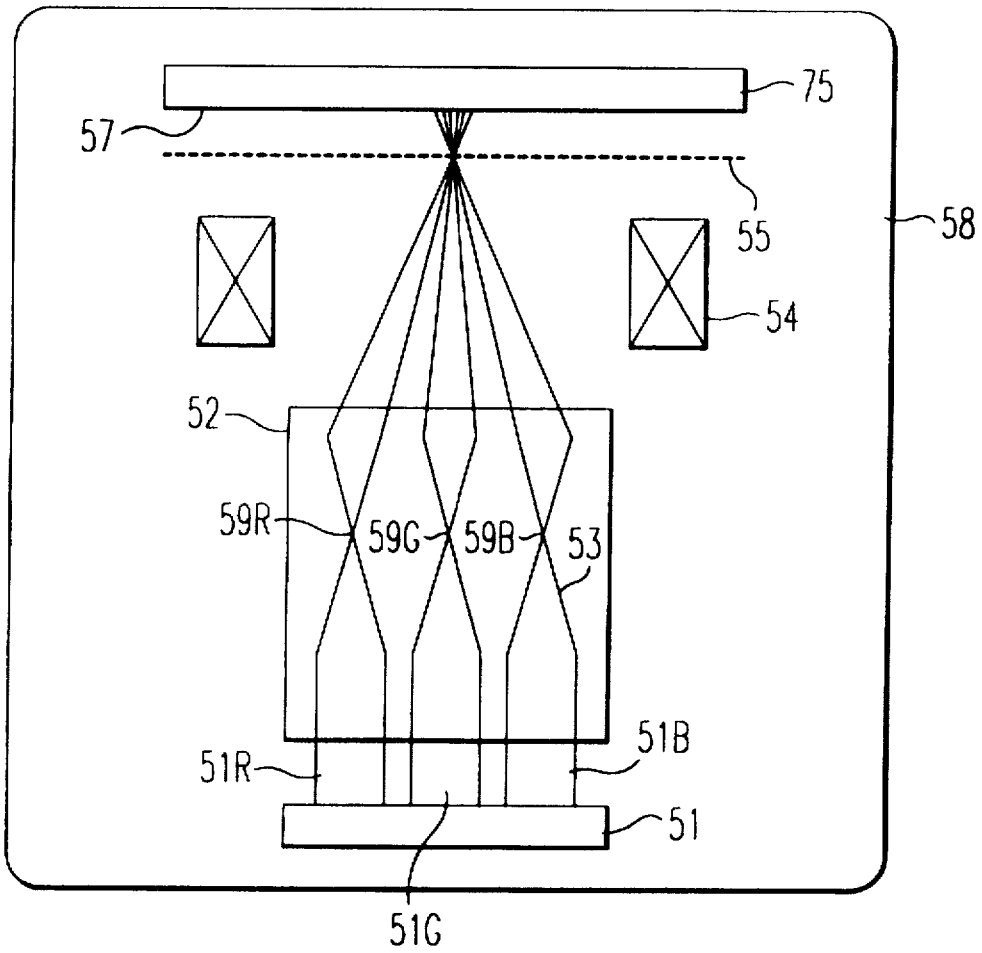
FIG. 16 is a cross-sectional view showing a configuration of a cathode ray tube incorporating a plurality of the electron sources of any one of the first to fourth embodiments of the present invention.
Figure 17:
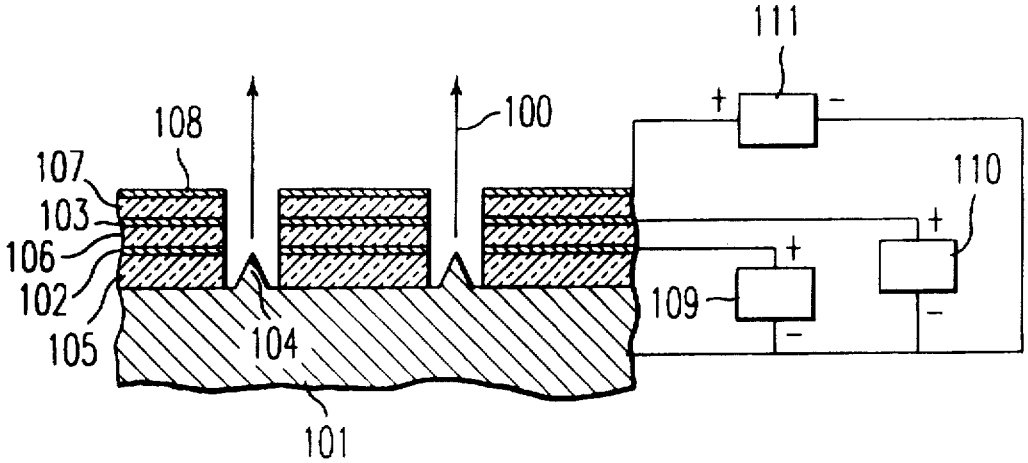
FIG. 17 BACKGROUND ART
FIG. 17 is a cross-sectional view illustrating a configuration of a background electron source.
Figure 18A:
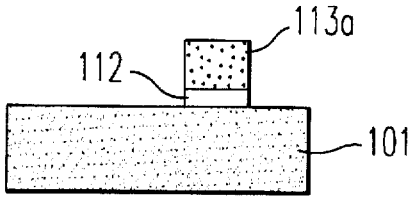
FIG. 18a BACKGROUND ART
FIG. 18(*a*) to FIG. 18(*f*) are cross-sectional views illustrating a manufacturing process for the background electron source.
Figure 18B:
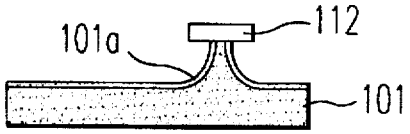
FIG. 18b BACKGROUND ART
Figure 18C:
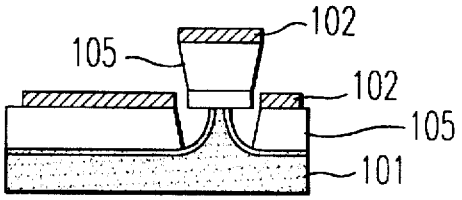
FIG. 18c BACKGROUND ART
Figure 18D:
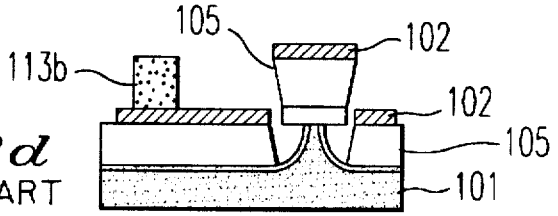
FIG. 18d BACKGROUND ART
Figure 18E:
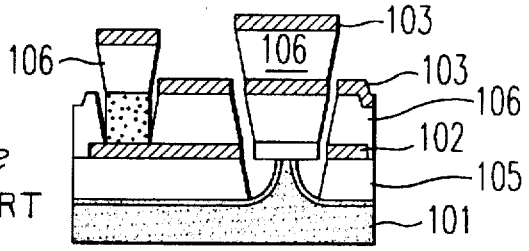
FIG. 18e BACKGROUND ART
Figure 18F:
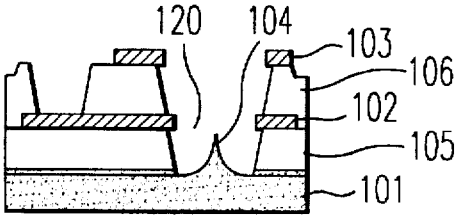
FIG. 18f BACKGROUND ART
Figure 19:
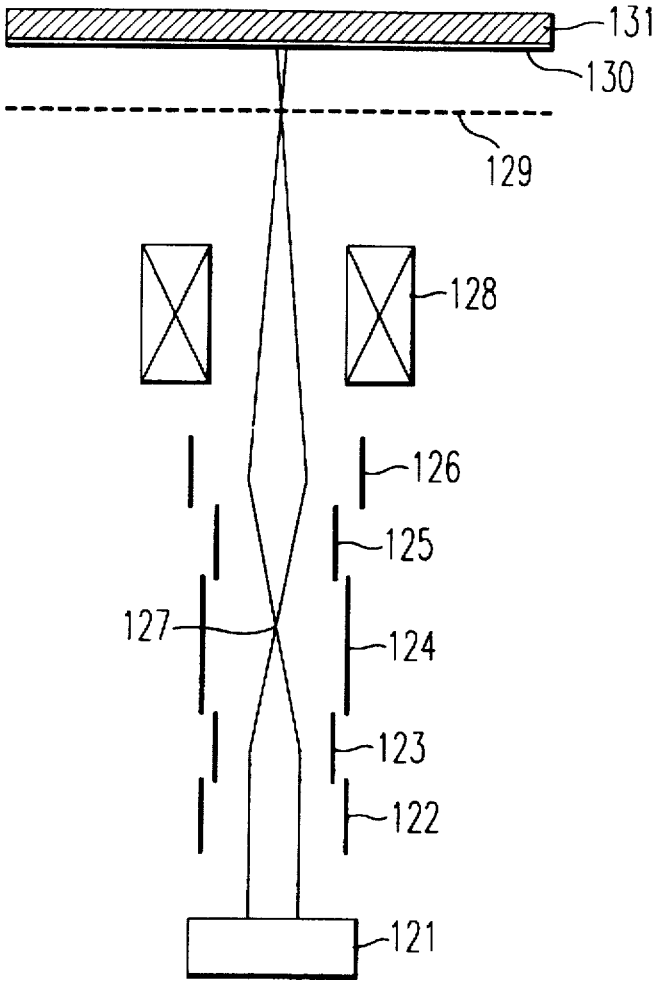
FIG. 19 BACKGROUND ART
FIG. 19 is a cross-sectional view illustrating a configuration of a background cathode ray tube.

FIG. 16 shows a further modification of this system of the present invention. More specifically, FIG. 16 shows a configuration of a cathode ray tube incorporating a plurality of electron sources 51R, 51G and 51B. Such a cathode ray tube can be utilized to form a color image from the individual electron beams 51R, 51G and 51B. Further, in the embodiment of FIG. 16, the plate 75 on which the electron beams 51R, 51G and 51B impinge is designed to be able to accommodate such plural electron beams.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the UNITED STATES is:

1. An electron source comprising:

a cathode electrode including at least one emitter of conical shape;

a first insulating film surrounding said at least one emitter;

a first extracting electrode disposed on said first insulating film and drawing out an electron from said at least one emitter;

a second insulating film disposed on said extracting electrode;

a focusing electrode disposed on said second insulating film for focusing the electron drawn out from said at least one emitter;

said first and second insulating films and said first extracting and focusing electrodes being hollowed to constitute a well surrounding said at least one emitter, and said first extracting electrode and focusing electrode have applied thereto predetermined voltages respectively to control emission of the electron from said at least one emitter; and means for suppressing a disturbance that the voltage applied to said focusing electrode causes to an electric field around a summit of said at least one emitter.

2. The electron source according to claim 1, wherein said suppressing means comprises controlling a ratio of a thickness of the first extracting electrode to a height of said at least one emitter to be set to 0.5 or more.

3. The electron source according to claim 1, wherein said suppressing means comprises controlling a ratio of a thickness of the second insulating film to a height of said at least one emitter to be set to 2.5 or more.

4. The electron source according to claim 1, wherein said suppressing means comprises a second extracting electrode inserted between said first extracting electrode and said focusing electrode.

5. The electron source according to claim 4, wherein said first and second extracting electrodes are applied a same potential voltage.

6. The electron source according to claim 4, wherein said first and second extracting electrodes are connected by an electrode shunt through an inner wall of the well.

7. An electron source comprising:

a cathode electrode including at least one emitter of conical shape;

a first insulating film surrounding said at least one emitter;

a first extracting electrode disposed on said first insulating film and drawing out an electron from said at least one emitter:

a second insulating film disposed on said extracting electrode:

a focusing electrode disposed on said second insulating film for focusing the electron drawn out from said at least one emitter:

said first and second insulating films and said first extracting and focusing electrodes being hollowed to constitute a well surrounding said at least one emitter, and said first extracting electrode and focusing electrode have applied thereto predetermined voltages respectively to control emission of the electron from said at least one emitter; and means for suppressing a disturbance that the voltage applied to said focusing electrode causes to an electric field around a summit of said at least one emitter, wherein said suppressing means comprises controlling a thickness of the first extracting electrode to be set larger than a height of said at least one emitter.

8. An electron source comprising:

a cathode electrode including at least one emitter of conical shape:

a first insulating film surrounding said at least one emitter:

a first extracting electrode disposed on said first insulating film and drawing out an electron from said at least one emitter:

a second insulating film disposed on said extracting electrode:

a focusing electrode disposed on said second insulating film for focusing the electron drawn out from said at least one emitter:

said first and second insulating films and said first extracting and focusing electrodes being hollowed to constitute a well surrounding said at least one emitter, and said first extracting electrode and focusing electrode have applied thereto predetermined voltages respectively to control emission of the electron from said at least one emitter: and means for suppressing a disturbance that the voltage applied to said focusing electrode causes to an electric field around a summit of said at least one emitter, wherein said suppressing means comprises controlling a ratio of a thickness of the first extracting electrode to a height of said at least one emitter to be set between 2 and 10.

* * * * *